US006412229B2

(12) United States Patent
Kuhns

(10) Patent No.: US 6,412,229 B2
(45) Date of Patent: Jul. 2, 2002

(54) ROOF VALLEY WATER COLLECTOR

(76) Inventor: Richard Kuhns, 210 Broad St., Red Bank, NJ (US) 07701

( * ) Notice: Subject to any disclaimer, the term of this patent is extended or adjusted under 35 U.S.C. 154(b) by 0 days.

(21) Appl. No.: 09/791,413

(22) Filed: Feb. 23, 2001

Related U.S. Application Data

(63) Continuation-in-part of application No. 09/444,322, filed on Nov. 19, 1999, now Pat. No. 6,256,933, which is a continuation-in-part of application No. 08/925,690, filed on Sep. 9, 1999, now Pat. No. 6,009,672.

(60) Provisional application No. 60/025,729, filed on Sep. 10, 1996.

(51) Int. Cl.[7] ..... E04D 13/00

(52) U.S. Cl. ..... 52/13; 52/11; 52/15; 52/97

(58) Field of Search ..... 52/11, 12, 13, 52/15, 24, 97, 58

(56) References Cited

U.S. PATENT DOCUMENTS

| | | | | | |
|---|---|---|---|---|---|
| 358,936 | A | * | 3/1887 | Krueger | 52/15 |
| 373,129 | A | | 11/1887 | Carroll | |
| 618,074 | A | * | 1/1899 | Dyer | 52/13 X |
| 853,897 | A | * | 5/1907 | Porter | 52/24 |
| 1,986,383 | A | * | 1/1935 | Usinger | 52/13 X |
| 2,120,395 | A | | 6/1938 | Dean | |
| 2,129,833 | A | * | 9/1938 | Fradette | 52/24 |
| 2,537,243 | A | | 1/1951 | Swartz | |
| 3,579,930 | A | * | 5/1971 | Murphy | 52/24 |
| 4,594,819 | A | * | 6/1986 | Kneisel | 52/13 X |
| 5,205,088 | A | * | 4/1993 | Mueller | 52/24 |
| 5,271,191 | A | | 12/1993 | Vahamaki | |
| 5,333,417 | A | | 8/1994 | Demartini | |
| 5,333,419 | A | | 8/1994 | Hickner | |
| 5,383,310 | A | | 1/1995 | Sapia | |
| 5,664,374 | A | * | 9/1997 | Lee | 52/24 |
| 5,673,520 | A | * | 10/1997 | Yannucci, III | 52/24 X |
| 5,675,939 | A | * | 10/1997 | Hickner | 52/13 X |
| 5,890,324 | A | * | 4/1999 | Maanum | 52/24 |
| 6,076,310 | A | * | 6/2000 | Kim | 52/97 |

* cited by examiner

*Primary Examiner*—Beth A. Stephan
*Assistant Examiner*—Brian E. Glessner
(74) *Attorney, Agent, or Firm*—Moser, Patterson & Sheridan LLP

(57) ABSTRACT

A water distributor for directing water from roofing configurations that form an inside roof valley to the rain gutters is disclosed. The water distributor directs the water from the roof valley without the distributor collecting debris or becoming clogged with leaves or twigs that may interfere with its function. Generally, the distributor includes a substantially triangular top portion having at least one trough extending therefrom.

26 Claims, 17 Drawing Sheets

ROOF VALLEY WATER COLLECTOR

This application is a continuation-in-part of U.S. Pat. application No. 09/444,322, filed Nov. 19, 1999 now U.S. Pat. No. 6,256,933, issued on Jul. 10, 2001, which is a CIP of Ser. No. 08/925,690 filed Sep. 9, 1999 U.S. Pat. No. 6,009,672, issued on Jan. 4, 2000, which claims benefit to U.S. Provisional Application No. 60/025,729, filed on Sep. 10, 1996. All of which are hereby incorporated by reference in their entirety.

BACKGROUND OF THE INVENTION

Field of Invention

The invention relates to a water collection device for use with existing rain guttering and roofing. More particularly, the invention relates to a water collector that is positioned within or proximate an inside valley of a roof to direct water in a more uniform manner to the guttering.

Background of Related Art

To eliminate clogging of rain gutters by debris, e.g., leaves, various rain gutter covers have been designed to channel water into a rain gutter, while, at the same time, keeping the debris from entering the rain gutter. One such rain gutter cover is disclosed in U.S. Pat. No. 5,216,851 issued Jun. 8, 1993, herein incorporated by reference. Such rain gutter covers function through water adhesion principles that channel water into the gutter via a plurality of apertures formed in the rain gutter cover. These apertures direct the water into the rain gutter while debris of sufficient size is excluded from entering the rain gutter. Typically, such rain gutter covers are attached between a roofline and a lip of the rain gutter along the entire length of the rain gutter.

However, two portions of a roof may meet at an angle (typically, 90 degrees) to form what is known as an inside corner or inside valley. In principle, water flowing along an inside valley flows onto the top flat portion of a gutter cover following a path to the collector portion where, through principles of surface adhesion, the water is delivered into the rain gutter as the debris carried by the water is jettisoned off of the gutter cover. However, the amount of water flowing from an inside valley may exceed the gutter cover's ability to collect the water, thereby permitting much of the water to overflow the gutter cover and to fall onto the ground resulting in soil erosion, basement leakage and so on.

In an attempt to redirect the rain water from the inside valley to a larger cross-section of gutter covers, vertical deflectors or fence-like devices have been installed on the gutter covers. These fence-like devices extend usually 1½ inches to 3 inches in height and are positioned to interrupt the flow of water before it reaches the gutter covers, thereby diverting the water laterally across the roofing or the horizontal portion of the gutter covers. In essence, the fence-like devices spread the large quantity of water within the inside valley across the roof. Unfortunately, tree debris, twigs, leaves, seeds, and so on accumulate behind the fence-like device, thereby reducing its effectiveness in diverting the rain water. Additionally, debris collecting behind the fence-like device contributes to the deterioration of the roofing material itself. To keep the fence-like device functioning, frequent cleaning is required, which is cumbersome, dangerous and contrary to the intended function of the gutter covers, i.e., keeping the rain gutters maintenance-free.

One fence-like device is disclosed in U.S. Pat. No. 5,333,417, issued Aug. 2, 1994 to Demartini. Demartini teaches diverging water diverting surfaces which divide water from valley configurations. The problem with this type of device is that it is designed to change the direction of the water coming down from a valley to a lateral direction. The sharp leading edge that extends normal to the roof surface catches pine, needles, twigs and other tree debris that contributes clogging the Demartini device with debris. Additional debris is in turn caught by any debris that is already hung up on the leading edge. Apertures in the diverting surfaces also catch pine needles, small twigs and leaf stems that further contribute to holding and collecting debris.

Additionally, the diverting surface taught by Demartini that is mounted generally perpendicular to the roof or gutter cover surface keeps water from flowing over the top of the diverter. Furthermore, the perpendicularly extending diverter disadvantageously holds debris up behind the diverting surface. Debris hung up behind the diverting surface clogs the flow of water (i.e., dams) behind the Demartini diverter. As this happens, water coming down the roof valley simply flows over the top of the diverting surfaces at the dam, rendering the diverting device useless.

Therefore, there is a need in the art for a maintenance-free water collection device that functions within an inside valley of the roof without collecting debris.

SUMMARY OF THE INVENTION

The present invention overcomes the disadvantages associated with the prior art. Specifically, the present invention is a water distributor for diverting water from roofing that forms an inside valley. The device provides the additional advantage of distributing the water without the device collecting tree debris or becoming clogged with leaves or twigs that may interfere with its function.

In one embodiment of the invention, a water distributor is provided having a substantially triangular top portion and at least one trough extending therefrom. Generally, the top portion has a first edge and a second edge for coupling the top portion to the roof valley. A front portion extends between the first edge and the second edge. The first trough has a first side and a second side, both of which extend outward from the top portion to divert the water flowing down the roof valley. The first side is disposed closer to the first edge than the second side. Optionally, a second trough may be disposed from the top portion on a side opposite the first trough.

Another embodiment of the invention comprises a substantially triangular water distributor having a top portion fastened to a first and a second rain gutter top which meet beneath a roof valley. The front edge of the top portion on each of its two ends transitions to a sloped trough that is highest on the end adjacent to the top portion. The rain water and debris from the roof valley is divided by a rear edge of the top triangular portion of the distributor and as it moves towards the front of one or both sides of the triangular top portion, the water and debris are directed into the sloped troughs. As water flows through the troughs, a controlled amount of water flows over the front edge of the sloped troughs which evenly distributes the water to the top of the rain gutter and the debris is also washed over the front edge of the trough or is washed through the trough and onto the top of the gutter cover.

BRIEF DESCRIPTION OF THE DRAWINGS

The teachings of the present invention can be readily understood by considering the following detailed description in conjunction with the accompanying drawing, in which.

To facilitate understanding, identical reference numerals have been used, where possible, to designate identical elements that are common to the figures.

DETAILED DESCRIPTION

In accordance with the present invention, a rain water collector is provided which can be installed in existing roof valley configurations in conjunction with existing guttering with or without gutter covers. The present water collector is installed in a manner that does not require fastening devices to be applied to the roofing materials. Hence, it is easily installed generally by a single, unskilled person, and it is easily removed and replaced without damaging the roofing.

Figure 1:
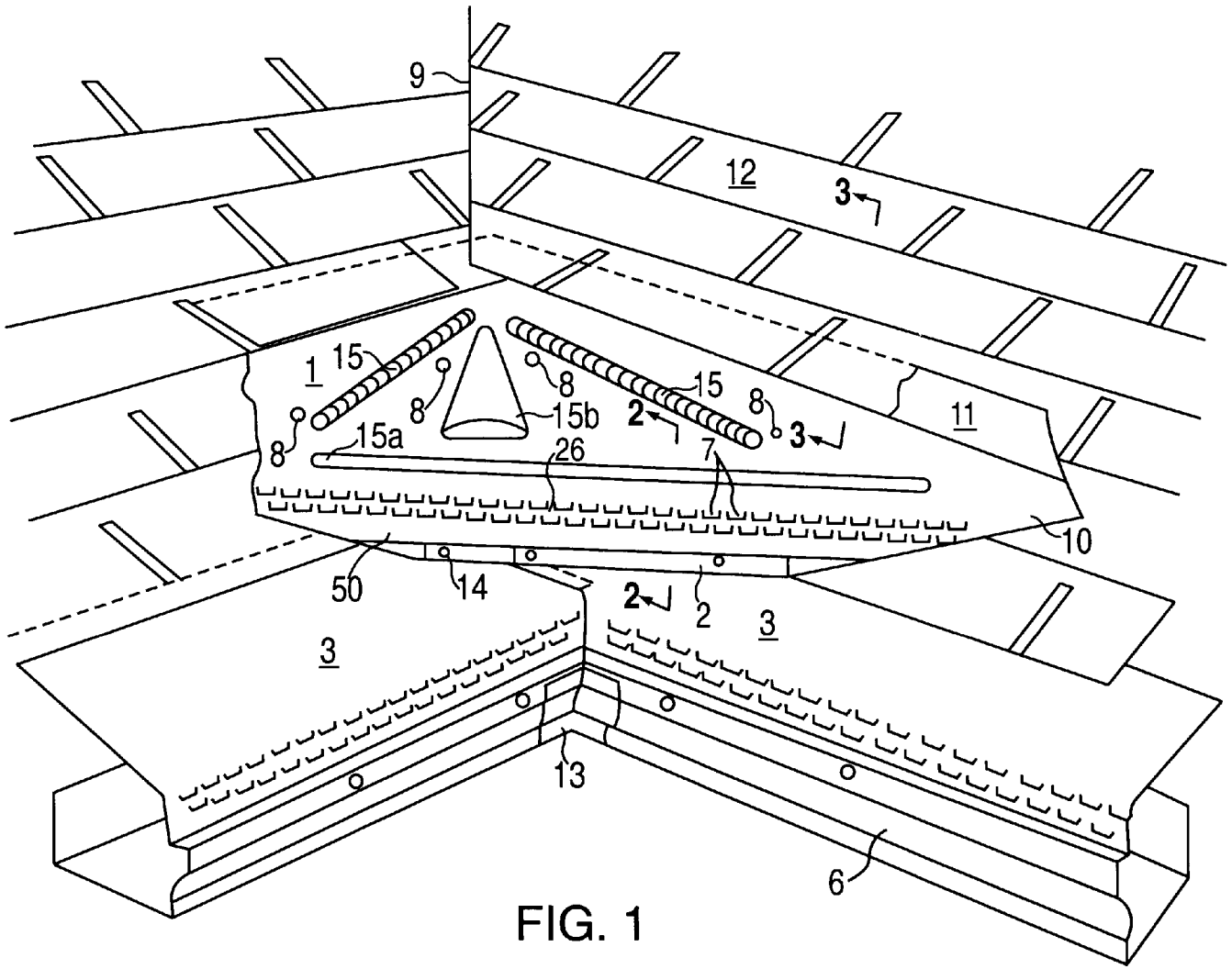
FIG. 1 is a perspective view of the preferred embodiment of the present water collector.
Figure 2:
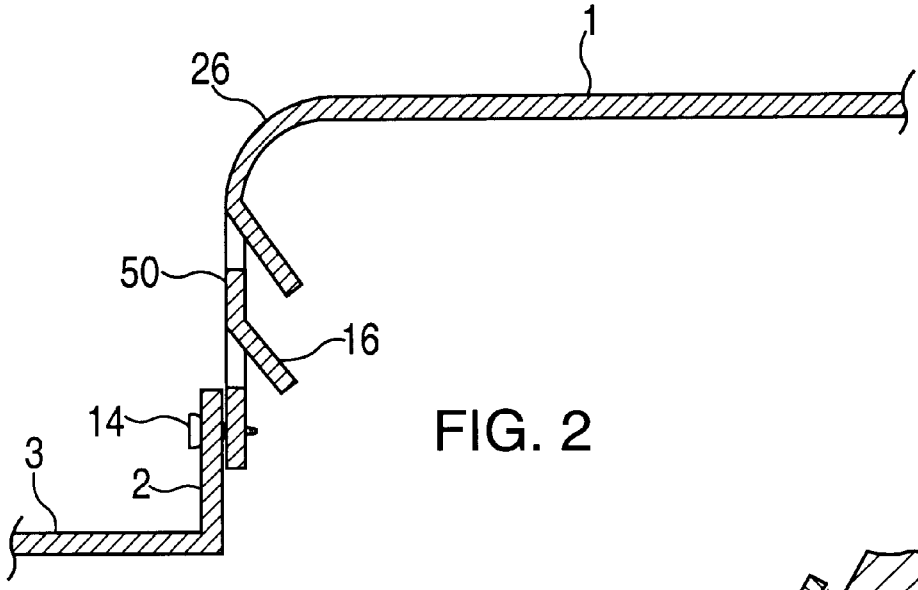
FIG. 2 is a sectional view of the preferred embodiment of the present water collector taken along line 2—2 of FIG. 1.
Figure 3:
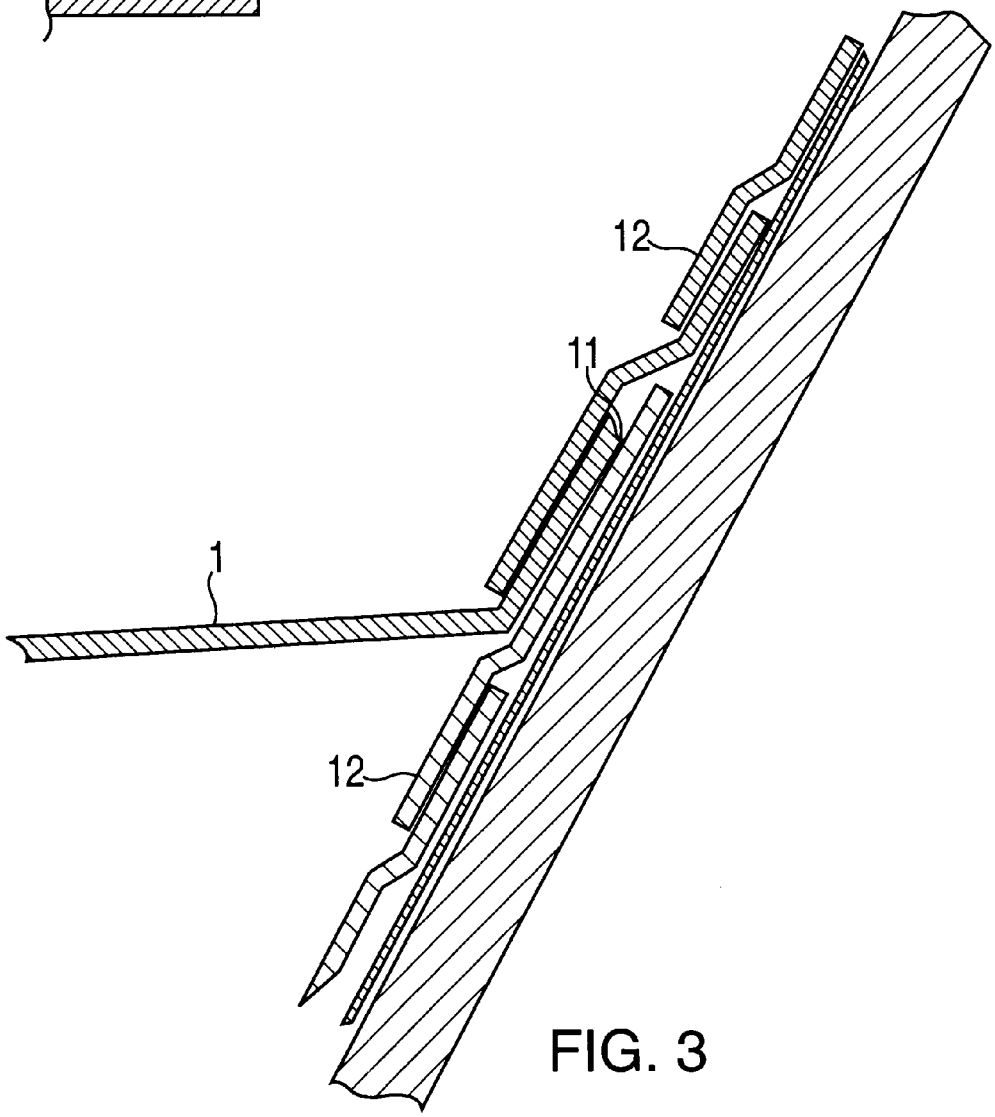
FIG. 3 is a sectional view of the preferred embodiment of the present water collector taken along line 3—3 of FIG. 1.

Referring to FIGS. 1–3, a rain water collector 10 is provided for an inside valley roofing configuration created by two intersecting rooflines 9. Such intersecting rooflines lead to a configuration of guttering connected at an angle, e.g., a right angle (at point 13). However, it should be understood that the present water collector can be implemented to accommodate a roofing juncture of any angles.

The water collector 10 has a closed-top portion 1 having a substantially triangular shape and a front portion 50. In the preferred embodiment, an arcuate front portion 26 is disposed between top portion 1 and front portion 50. Although the present invention is described below with an arcuate front portion 26, it should be understood that the present invention can be modified and implemented without the arcuate front portion 26.

More specifically, the arcuate front portion 26 extends from the top portion into a vertically disposed front portion 50. The front portion 50 may have a plurality of apertures 7 to direct rain water into a rain gutter. However, if a rain gutter cover 3 is available, vertically disposed front portion 50 can be attached along its bottom edge to a flange 2 of the rain gutter cover 3. Water collector 10 is constructed of a unitary sheet of constructed metal such as aluminum, aluminum copper alloy, vinyl or other weather resistant plastic. In one illustrative example, the unitary sheet has a length of approximately three (3) feet and a width of between 8 and 20 inches.

Although the present invention is implemented as a unitary sheet, those skilled in the art will realized that the present invention can be implemented having more than one sheet of material. Furthermore, it should be understood that the size (including the angles between the various portions of the water collector) of the present water collector can be adjusted to accommodate the dimension of a particular roof valley. For example, the front portion 50 does not have to form a right angle with respect to the top portion 1, i.e., these portions are not limited to a horizontal or a vertical configuration. Both portions can be implemented with a slope or pitch with respect to a horizontal or vertical axis.

The top portion 1 is installed such that the front arcuate portion 26 is substantially level (e.g., horizontal) and the top portion 1 is slightly pitched (e.g., 1 to 15 degrees) away from the valley. Such pitch enables water to drain toward the front arcuate portion 26 from an optional rear flap 11 extending from the top portion 1 at an angle that matches the slope of roofing 12. Rear flap 11 is optional, since it is possible to fabricate the water collector such that the top portion 1 is pitched at an angle that matches the slope of roofing 12, thereby allowing a portion of the top portion 1 to be directly inserted between the roofing material without the need of a rear flap. However, if the slope of the roofing 12 is particularly sharp, the angled rear flap allows the top portion 1 to be pitched slightly, i.e., having a less inclined slope than the roofing, thereby allowing the rain water to spread out as it travels across the top portion 1. Therefore, it is generally preferred to incorporate an angled rear flap on the water collector for roofing that has a sharp slope.

To install the water collector 10, flap 11 is slid between the roofing material such as roof shingles, to cause the water collector 10 to be stationary with respect to the roofing as shown in FIG. 3. To complete the installation, the bottom portion of vertically disposed front portion 50 is fastened with screws, rivets or clips 14 to the flange 2 of the top flat portion of gutter cover 3 as shown in FIG. 2. In the event that a gutter cover 3 is not used, the bottom portion of vertically disposed front portion 50 can be attached directly to the rain gutter 6.

The top portion 1 is also provided with longitudinal ridges or weirs 15 extending approximately ⅛ inches to ½ inches in height for spreading water to the edges of the collector adjacent to the roofing. The purpose of these ridges is to distribute the rain over a greater surface, so that the rain can be directed into the rain gutter at different points. Although a set of ridges 15 is shown in FIG. 1, those skilled in the art will realize after considering this specification that ridges of different quantity, shape and size can be employed on different locations on the top portion 1 to achieve the same effect.

For example, in an alternate embodiment, a single ridge 15*a* which is parallel to the front arcuate portion 26, may extend substantially across the entire width of the water collector. In yet another embodiment, a single ridge 15*b* which starts near the juncture of the rooflines, may extend horizontally and vertically toward the arcuate portion 26. This ridge 15*b* may have a dome like shape.

The vertical front portion 50 may contain one or more rows of a plurality of apertures 7, where each aperture contains a flap 16 connected to the top of the aperture, such that the flap 16 extends inwardly toward the rain gutter. These apertures can be formed integrally with the substantially vertical front portion 50 by stamping, piercing, or die cutting the flaps from the front portion and by bending the flaps inwardly.

Due to the principle of surface adhesion, rain traversing over the top of the aperture 7 is drawn into the aperture via the flap 16. The configuration of these rows of apertures is such that all generally vertical paths of rain flow downwardly across the vertical front portion 50, are interrupted by at least one of these apertures 7. The size of these apertures (approximately ½ inch by ¾ inch) should be sufficiently small so as to generally prevent leaves and other debris from entering the rain gutter. Those skilled in the art will realize after considering this specification that apertures of different quantity (including the number of rows), shape and size can be employed to achieve the same water channeling effect.

Referring to FIG. 1, the top portion 1 can also be optionally provided with openings 8 for the purpose of directing rain into the rain gutter. Again, the size of these openings (approximately 1/16 inch to ¼ inch in diameter) should be sufficiently small so as to generally prevent leaves and other debris from entering the rain gutter. These openings 8 are typically distributed over the surface of top portion 1 to enhance the guidance of rain water into the rain gutter. Since water collector 10 is positioned directly over both a portion of the roofing 12 and the rain gutter 6, water entering these openings 8 is either directed to the rain gutter 6 directly or to a different portion of the roofing 12 underlying the water collector 10. In both cases, the desired effect of spreading and directing rain water from the inside valley of a roof into a rain gutter 6 is accomplished.

Those skilled in the art after considering this specification will realize that this water collector 10 can be modified to adopt to valley configurations adjacent to non-connecting guttering at right angles as well as valleys having no roof edge which is adjacent to guttering, or valleys created by a dormer leading to straight guttering. Those skilled in the art after considering this specification will also realize that this water collector 10 can be modified to work with all types of roofing, including but not limited to, wood shingles, metal, slate, tile, and so on. In fact, the present water collector 10 can be used with open unprotected guttering.

Additionally, FIG. 4 through FIG. 15 illustrate various alternate embodiments of the present invention having a water distributor that is used in conjunction with roof valleys to be installed on new or existing rain guttering. Generally, the water distributor, described in a number of illustrative embodiments detailed below, spreads rain water flowing down a roof valley across the roof surface so that the rain water may be collected by the rain gutter without overflowing. The utility of the water distributor, discussed below, provides a method distributing rain water into the rain gutter without becoming clogged with leaves and other debris. Additionally, the water distributor is easily installed by one unskilled person. Of course, one skilled in the art will be readily able to devise additional variants of the water distributor through use of the teachings disclosed herein.

Figures 4, 9:
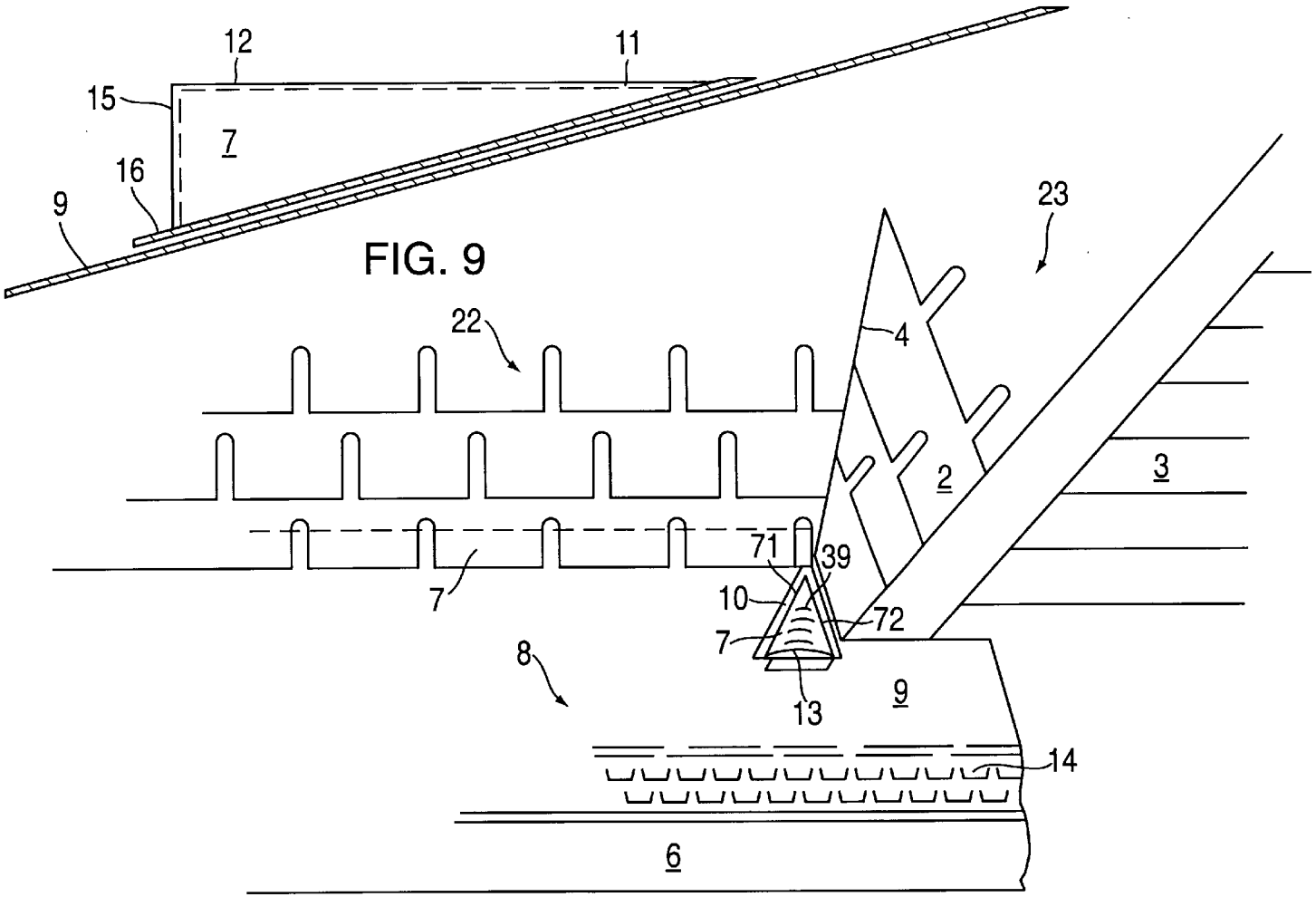
FIG. 4 is a perspective view of another embodiment of a water distributor.
FIG. 9 is a side view of the water distributor of FIG. 5.
Figure 7:
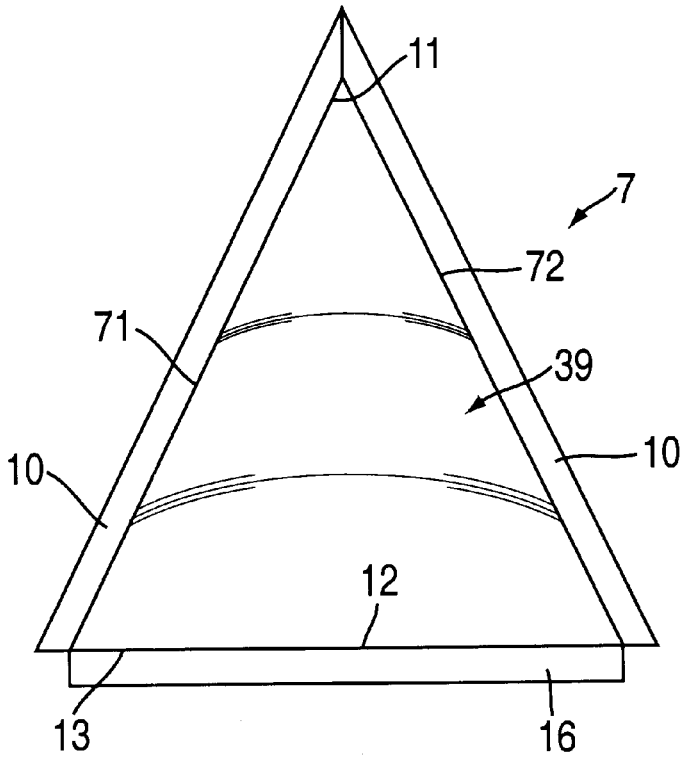
FIG. 7 is a top view of the water distributor of FIG. 4.
Figure 5:
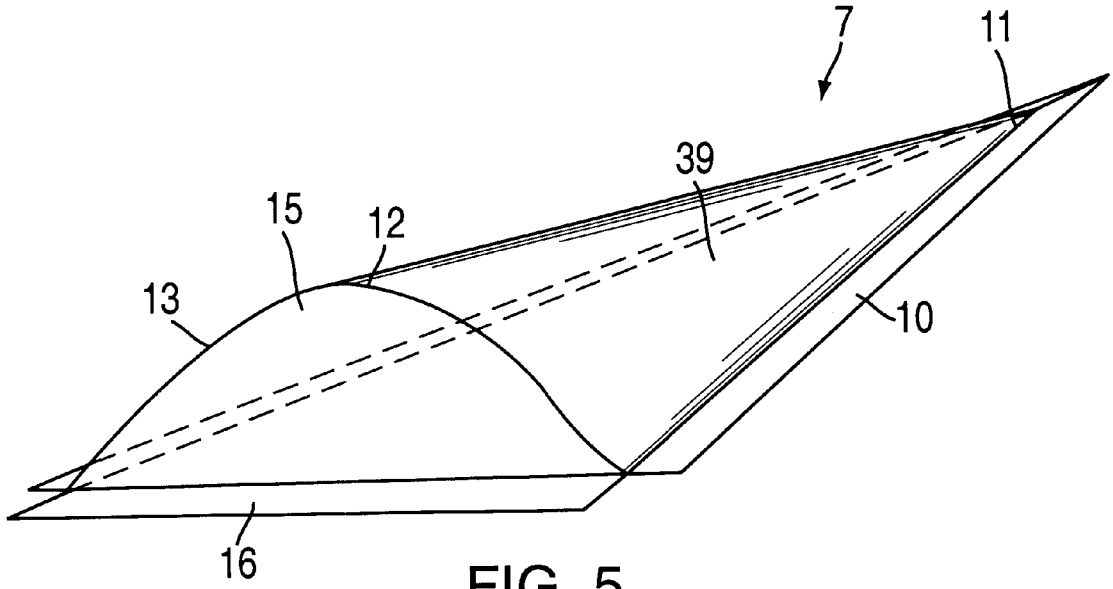
FIG. 5 is a perspective view of the water distributor of FIG. 4.

FIG. 4 is a perspective view of an alternate embodiment of the water distributor invention. In FIG. 4, roofing shingles 1 covering a first sloped roof 22 of a building, such as a dwelling house or other structure, are attached to the roof 22 parallel and adjacent to a rain gutter 6. The rain gutter 6 is optionally fitted with a gutter cover 8. Roofing shingles 2 covering a second roof 23 are mounted on a gable portion 3 of the dwelling house and are generally perpendicular to the rain gutter 6. The roofing shingles 1 and 2 meet to form a roof valley 4 along the intersection of the roofs 22 and 23. Water collected from roofs 22 and 23 flows down the roof valley 4 to the gutter cover 8 mounted on the rain gutter 6.

In accordance with the present invention, as shown in FIG. 4 through FIG. 9, a water distributor 7 is attached by a fastening means, such as screws or rivets, to a top portion 9 of a rain gutter cover 8 affixed to a rain gutter 6. The water distributor 7 may be alternately attached to a roof valley 4. Rain water from the roofing shingles 1 and 2 flows down the roof valley 4 onto the top portion 9 of gutter cover 8 along with any tree debris such as blossoms and leaves.

The water distributor 7 has a substantially triangular top surface 39 bounded by a first edge 71, a second edge 72 and a bowed edge 13. The first edge 71 and the second edge 72 are generally straight and have an equal length. Alternately, the first edge 71 and the second edge 72 may have unequal lengths. At least one flange is coupled to the first edge 71 or the second edge 72. Preferably, a flange 10 is present on both the first edge 71 and the second edge 72. Alternately, the flange 10 may be replaced by one or more tabs. The flange 10 is fastened to the roof or a top 9 of the gutter cover 8, thus securing the water distributor 7. Generally, the water distributor 7 is fabricated from one unitary sheet of metal or plastic, although multiple piece construction may be utilized. The reader should note that the flange 10 may be incorporated within the top surface 39 when the top surface 39 is fastened directly to the top 9 of the gutter cover 8 with a screw, nail, rivet or other type of fastener.

The bowed edge 13 is generally curved in form, having a high point 12 that is generally centered along the bowed edge 13. The two straight edges (71 and 72) and the bowed edge 13 generally cause the top surface 39 to be curved (domed shaped).

A rear portion 11 of the top surface 39 is positioned at the intersection of the first and second edges 71 and 72. The rear portion 11 is attached on top portion 9 of gutter cover 8 at the point of highest concentration of water flowing from the roof valley 4. The bowed edge 13 is generally (although not necessarily) installed parallel to the rain gutter 6. As the rain water and other debris flow onto the water distributor 7, the water and other debris are spread out laterally across water distributor 7 as the flow moves closer to the highest point 12. The flow of water from the roof valley 4 thus is evenly distributed into a wider flow across the water distributor 7. The resulting wider flow is more readily accommodated by the gutter cover 8. By spreading out the volume of water traveling down the roof valley 4, apertures 14 in the gutter cover 8 are able to effectively collect most of the water while rejecting the debris to the ground. Alternately, the water distributor 7 may be affixed directly to the roof valley 4.

An optional front portion 15 covers the front of the water distributor 7 and is fastened to the top 9 of the gutter cover 8 with fasteners such as screws or rivets through a flange 16. The water distributor 7 can be made integrally with the front portion 15 from one unitary sheet of metal or plastic. Alternate forms of plastic fabrication also result in one piece construction. Alternately, the front portion 15 and water distributor 7 can be fabricated from a plurality of separate pieces of metal or plastic (such as aluminum, aluminum copper alloy, coated steel, vinyl or other weather resistant plastic) joined together by methods known to those in the industry. Rather than the front portion 15 being joined at a right angle to the bowed edge 13 of the water distributor 7, an arcuate surface (not shown) can be used to join them together. Likewise, apertures, (not shown) to collect water can be located in the front portion 15 of water distributor 7 if the water distributor 7 is affixed over the rain gutter 6.

Figure 8:
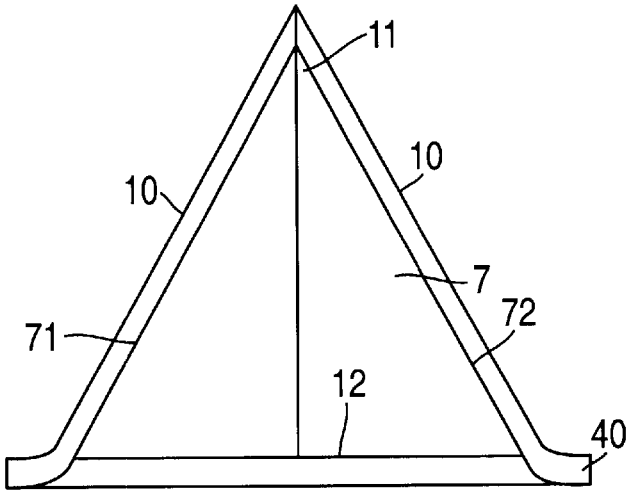
FIG. 8 is a top view of the water distributor of FIG. 6.
Figure 6:
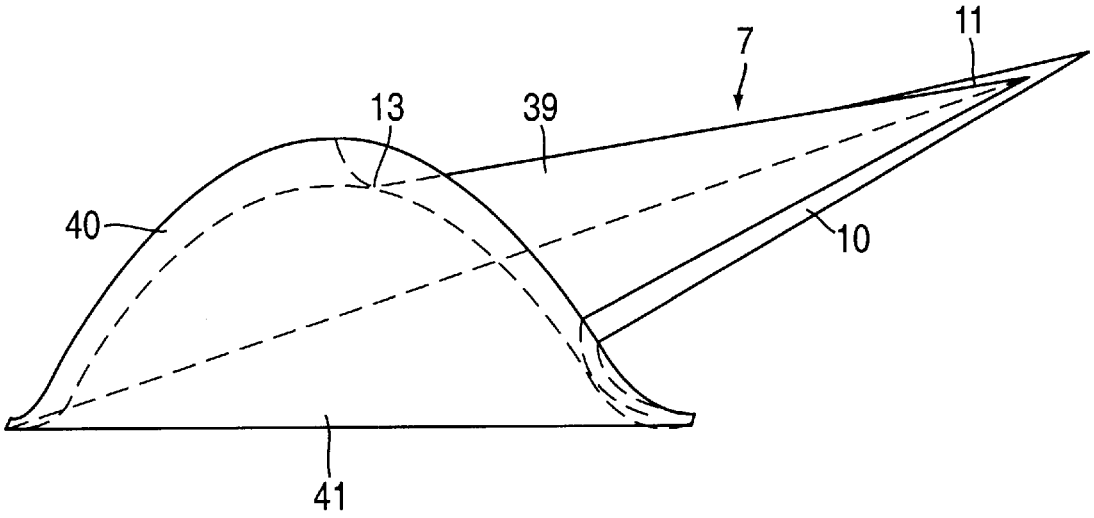
FIG. 6 is a perspective view of another embodiment of the water distributor.

Another embodiment depicted in FIG. 6 and FIG. 8 illustrates a water distributor 7 wherein the bowed edge 13 terminates in a lip 40 flared at an angle between 0 and 135 degrees from the top surface 39 of the water distributor 7. In one embodiment, the lip 40 is flared between 60 and 120 degrees. The lip 40 interrupts the flow of water over the water distributor 7, directing a greater portion of the flow toward the first and second edges 71 and 72. Those skilled in the art will recognize that the front portion 15 (of FIG. 5) can be extended beyond the bowed edge 13 in a manner to incorporate the lip 40 into a front panel 41.

Figure 10:
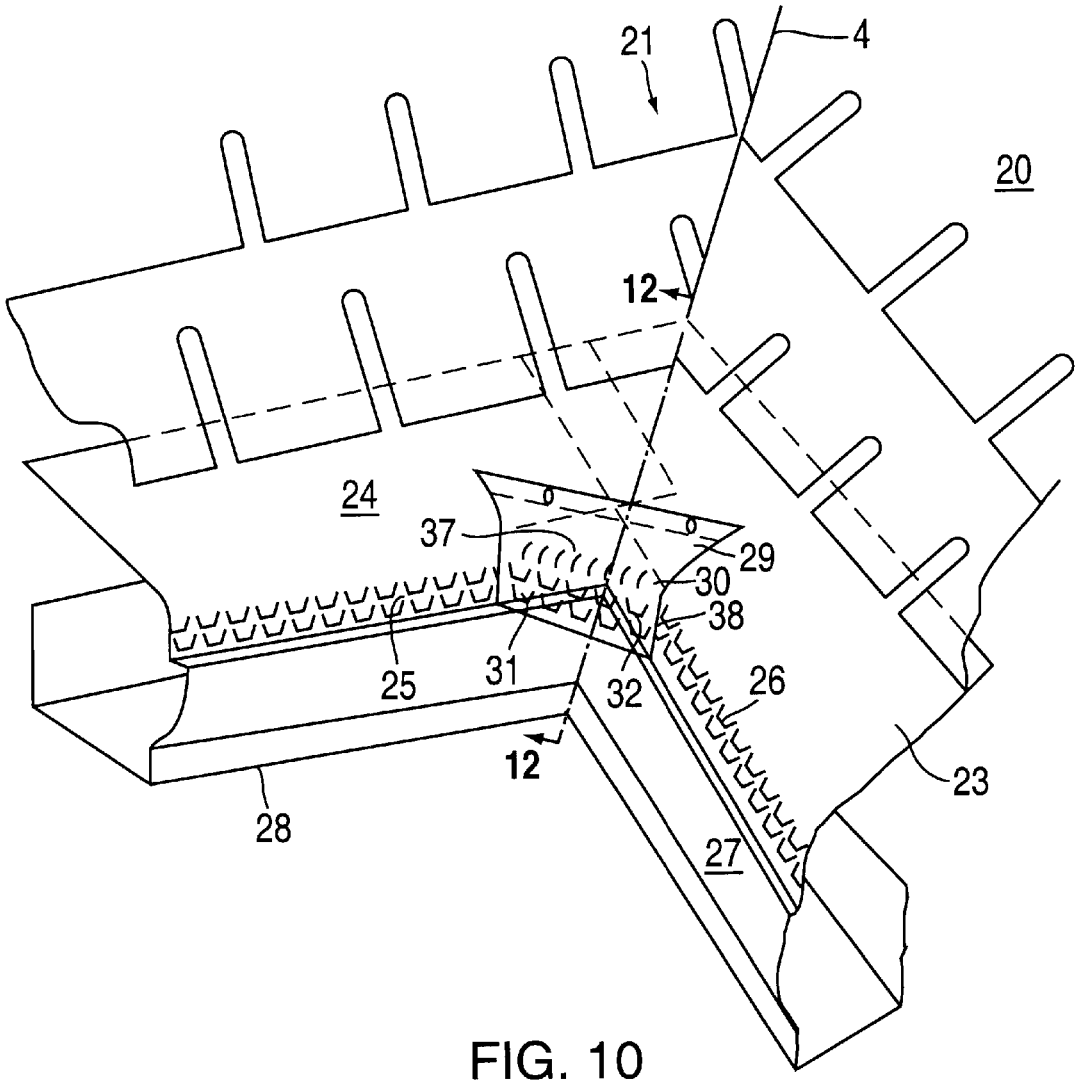
FIG. 10 is a perspective front-top view of another water distributor incorporated at the intersection area of two perpendicular gutter covers and roofing.
Figure 11:
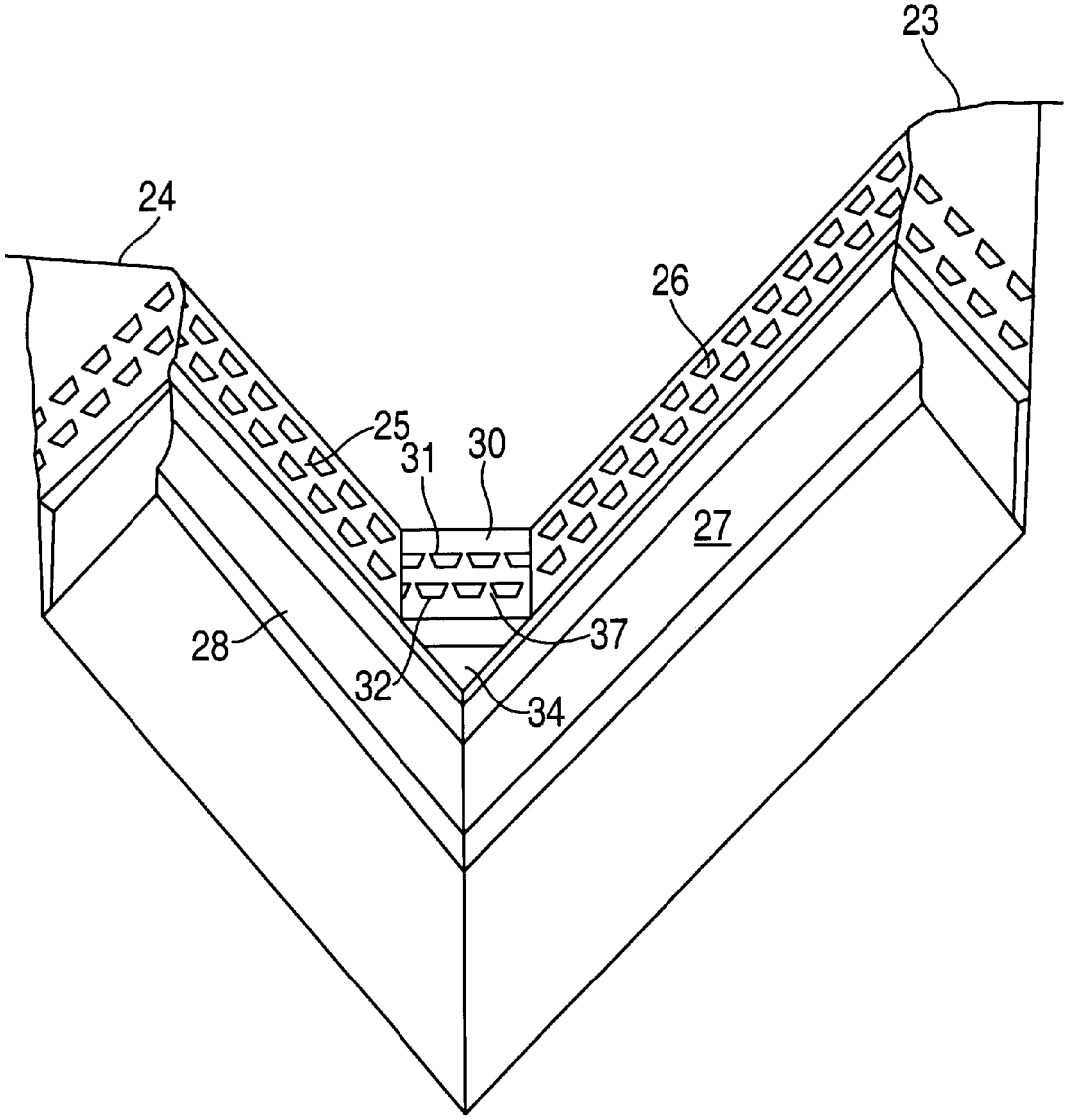
FIG. 11 is a perspective front-bottom view of the water distributor of FIG. 10.
Figure 12:
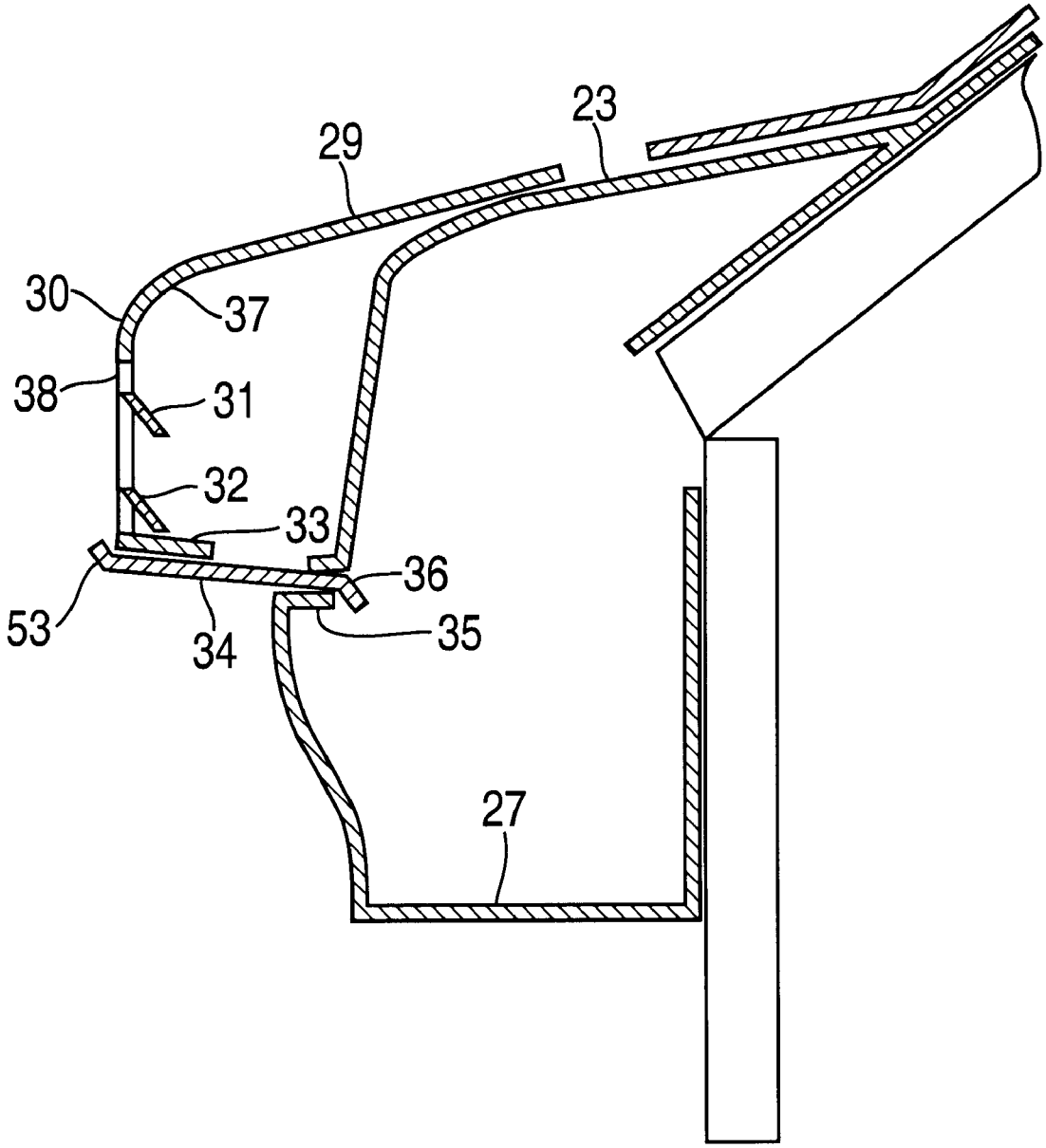
FIG. 12 is a cross sectional detail taken along section line 12—12 of FIG. 10.

Another embodiment of the invention is depicted in FIG. 10, FIG. 11 and FIG. 12. In accordance with the present invention, a water distributor 29 has a top portion 37 fastened to a first rain gutter cover 23 and a second rain gutter cover 24 that are attached to the roof valley 4. The top portion 37 transitions into a vertical section 38 that has at least one aperture (depicted as a first row of apertures 31 and a second row of apertures 32). A generally triangular member 34 is coupled between the vertical section 38 and a rain gutter 27 and a rain gutter 28. The water distributor 29 can be installed in existing roof valley 4 configurations in conjunction with existing rain guttering or gutter covers. The present water distributor 29 additionally can be installed in a manner that does not require fastening devices to be applied to the roofing materials.

Rain water and other debris such as leaves and blossoms flow downward from the two sloped roofs 20 and 21 into the roof valley 4. The rain water flows down the roof valley 4 and onto the tops of two gutter covers (23 and 24) connected together and perpendicular to each other. Water and debris flow onto the top portion 37 of the water distributor 29 leading to a front arcuate portion 30 that transitions to the vertical surface 38 in which there are preferably two rows apertures 31 and 32. The apertures 31 and 32 allow water to flow through the water distributor 29 while being of sufficiently small size such that the debris can not enter.

A bottom flange 33 coupled to the vertical surface 38 of water distributor 29 is attached to the member 34. Water entering the apertures or louvers 31 and 32 of the water distributor 29 is directed by the apertures 31 and 32 onto the member 34. The member 34 is sloped to allow the rain water on the member 34 to flow from the water distributor 29 into the respective gutters 27 and 28. The member 34 has a front flange 53 in which a front edge of the bottom flange 33 of the water distributor 29 is nested. The rear portion of member 34 is fastened with screws, rivets, clips, adhesives or other fasteners (not shown) to an upper front lip 35 of the rain gutter 27 and 28. The rear of the member 34 has a drip edge 36 turned downward and into gutter to direct rain water entering the respective gutter 27 and 28.

Although the present invention is implemented as separate pieces utilizing two rows of apertures (louvers) those skilled in the art will realize that the present invention can be fabricated from one unitary sheet or from individual pieces joined together in various ways known to those skilled in the art. Those skilled in the art will also recognize that gutter covers 23 and 24 can be joined together as one unitary sheet with water distributor 29 integrally built in. Those skilled in the art will additionally be able to substitute other types of water apertures in place of apertures 31 and 32 without deviating from the scope of this invention.

Figure 13:
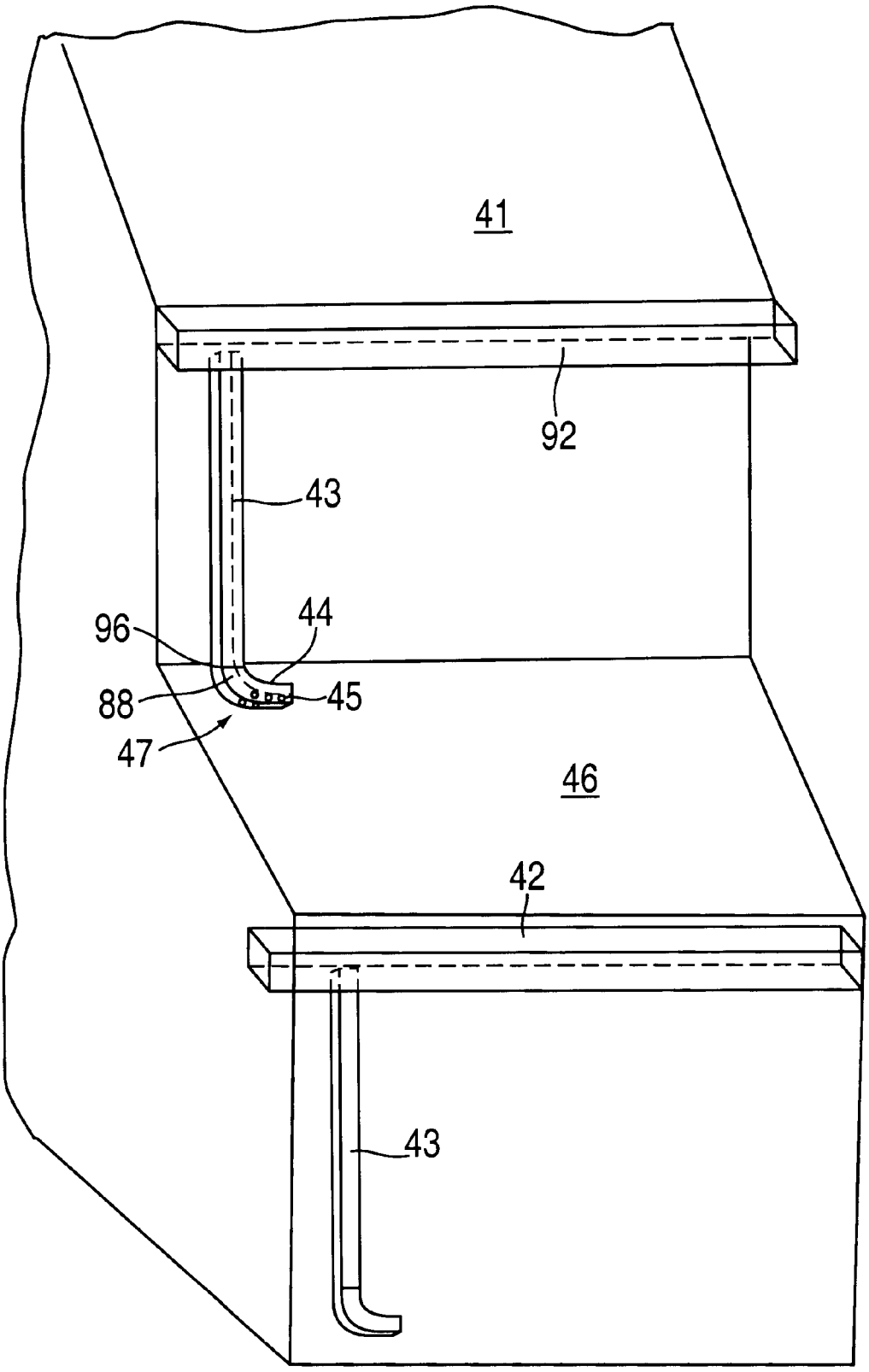
FIG. 13 is a perspective view of another water distributor incorporated into a discharge elbow.
Figure 14:
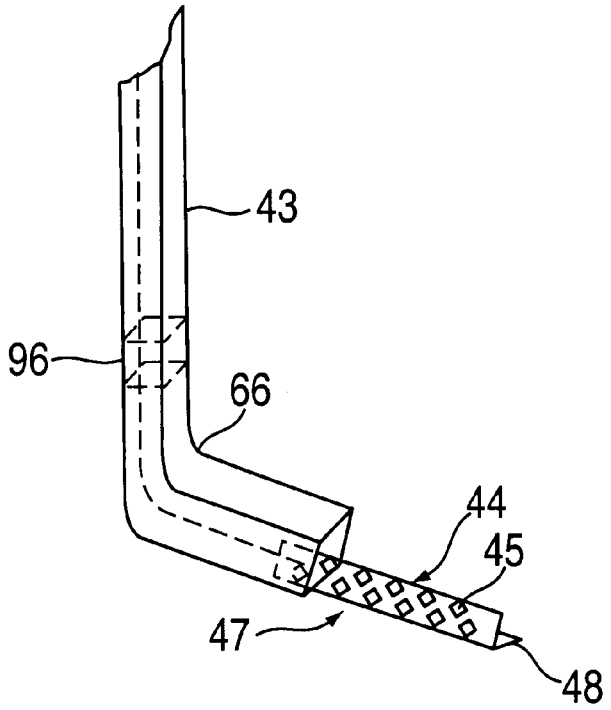
FIG. 14 is a perspective view of another water distributor incorporated into a discharge elbow.
Figure 15:
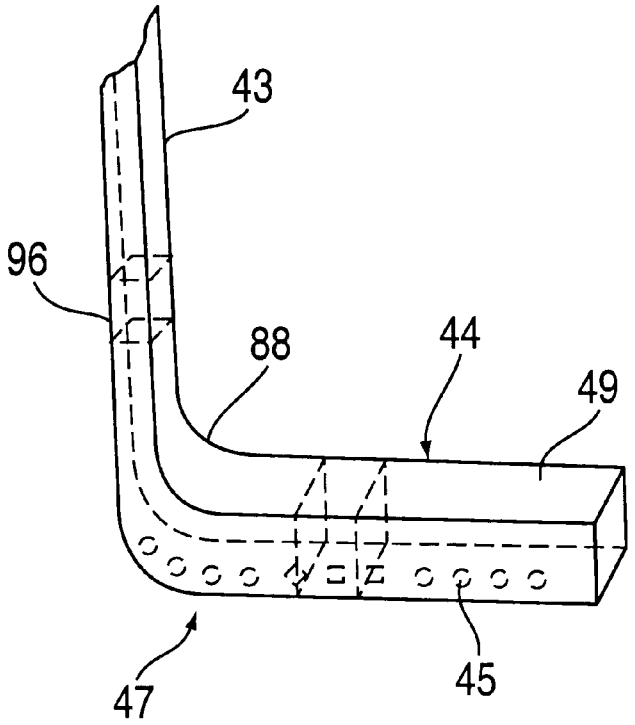
FIG. 15 is a perspective view of another water distributor incorporated into a discharge elbow.

FIG. 13, FIG. 14 and FIG. 15 depict alternate embodiments of the invention. The water distributor 47 directs water from a first roof surface 41 across a second roof surface 46 to a rain gutter 42. Rain water from the first roof surface 41 is channeled though a leader 43 having the water distributor 47 that spreads the rain water exiting the leader 43 across the second roof surface 46. Distributed water flows down the second roof surface 46 and is collected by the rain gutter 42.

The water distributor 47 comprises an end 96 connected to a discharge section 44. The end 96 is configured to mate with conventional leaders 43.

The discharge section 44 has a plurality of holes 45 through which water flowing through the discharge section 44 is spread across the section roof surface 46. The discharge section 44 may have varied configurations. For example, the discharge section 44 may comprise an "L" shaped extension 48. Other examples of configurations for the discharge section 44 include a rectangular extension 49. The discharge section 44 may additionally be incorporated into a discharge elbow 88 wherein the holes 45 are disposed on the discharge elbow 88. The extensions 48 and 49 may be coupled to a conventional elbow 66 or a discharge elbow 88.

When water from the upper roof 41 is collected in an upper gutter 92 and flows down the leader 43 to the water distributor 47. The openings 45 of water distributor 47 facilitate distributing the water exiting the leader 43 laterally along roof 46. Thus, the water stream exiting the leader 43 is consequently not concentrated in high volume vertical stream when reaching the lower gutter 42. This enables the lower gutter 42 to substantially capture the entire flow of water exiting the leader 43 and distributed by the water distributor 47. Those skilled in the art recognize that the quantity of openings, their size and shape can be varied while maintaining the utility of the invention. The lower gutter 42 may have screen or gutter cover similar to that shown in FIG. 4. Those skilled in the art will readily recognize that the gutter 42 may be covered with any type of cover or screen or may be in the form of a gutter and water collector all in one.

Another aspect of the invention is described with reference to FIGS. 16–19 which depict one embodiment of a water distributor having at least a first trough for diverting water from a roof valley. The water distributor may be coupled to one or both of the roof surfaces forming the roof valley to distribute a volume of water flowing down the roof valley across the roof surfaces so a gutter positioned under the roof surfaces may better accommodate the volume of water flowing from the roof valley without over-flowing.

Alternatively, the water distributor may be positioned on a gutter cover coupled to the roof surfaces forming the roof valley.

Figure 16A:
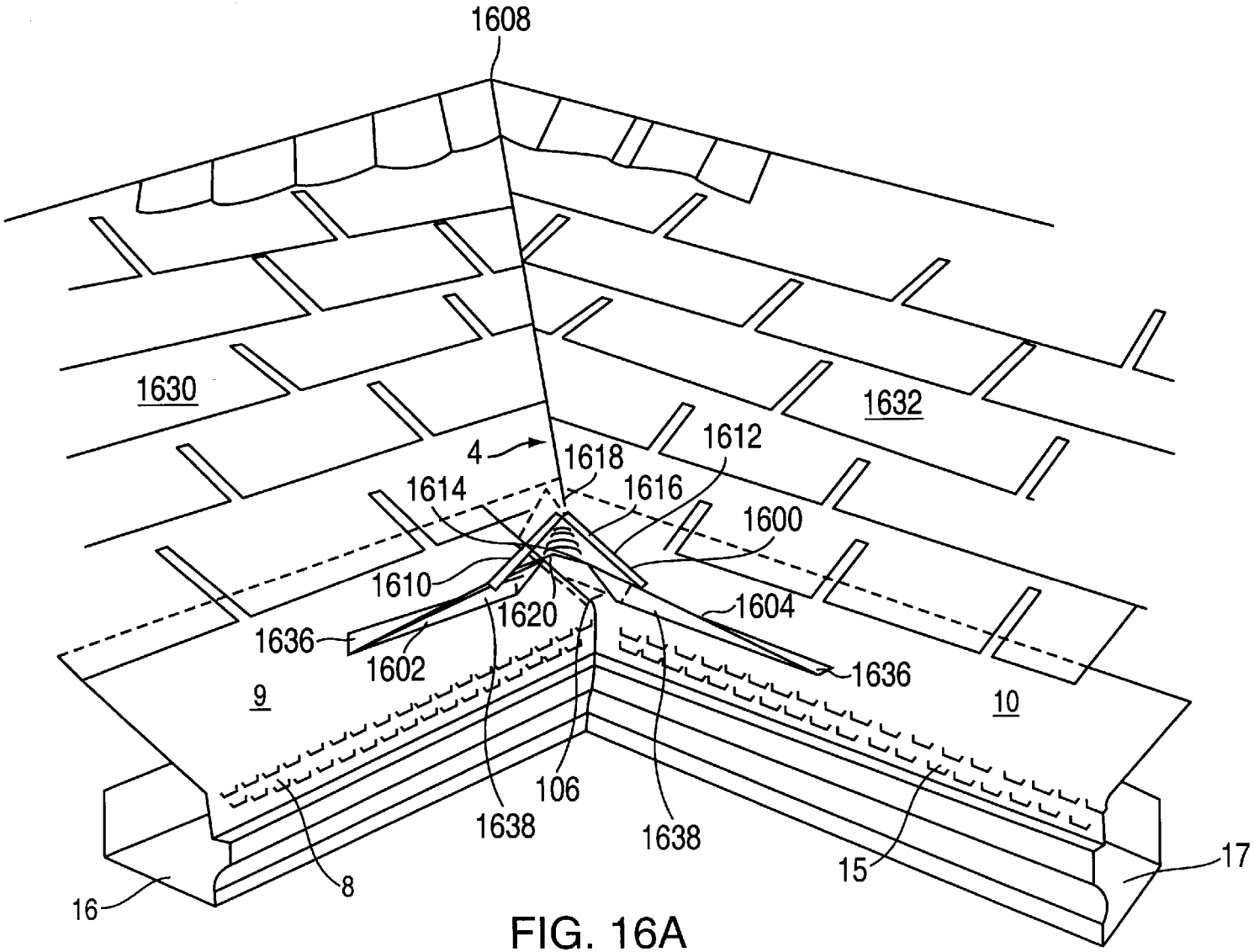
FIG. 16A is a perspective view of another water distributor incorporated at the intersection area of two perpendicular gutter covers and roofing.

FIG. 16 A depicts a perspective view of one embodiment of a water distributor 1600 incorporated at the intersection area of two perpendicular gutter covers and roofing. The water distributor 1600 is configured similarly tot he rain collectors described with reference to FIGS. 1–9 and 16A–19 above. Generally, the water distributor 1600 includes a first edge 1610, a second edge 1612 and a third edge 1614 that define a substantially triangular top portion 1616. The first and second edges 1610, 1612 intersect defining a rear portion 1618 that is positioned towards a peak 1608 of the roof when installed on the roof valley 4. The third edge 1614 may be bowed or peaked to create a high point 1620 along the third edge 1614 that distributes the water running onto the top portion 1616 across the third edge 1614, thus keeping the gutters 16, 17 positioned below from over-flowing.

The third edge 1614 is generally curved in form, having the high point 1620 typically centered along the third edge 1614. The first and second edges 1610, 1612 are generally straight and, along with the third edge 1614, generally cause the top surface 1616 to be curved or dome shaped. Generally the distributor 1600 is attached with screws, rivets, fasteners, adhesives or the like to tops of gutter covers 9 and 10 with flanges 1622 and 1624 shown in FIG. 17 and FIG. 18.

Figure 16B:
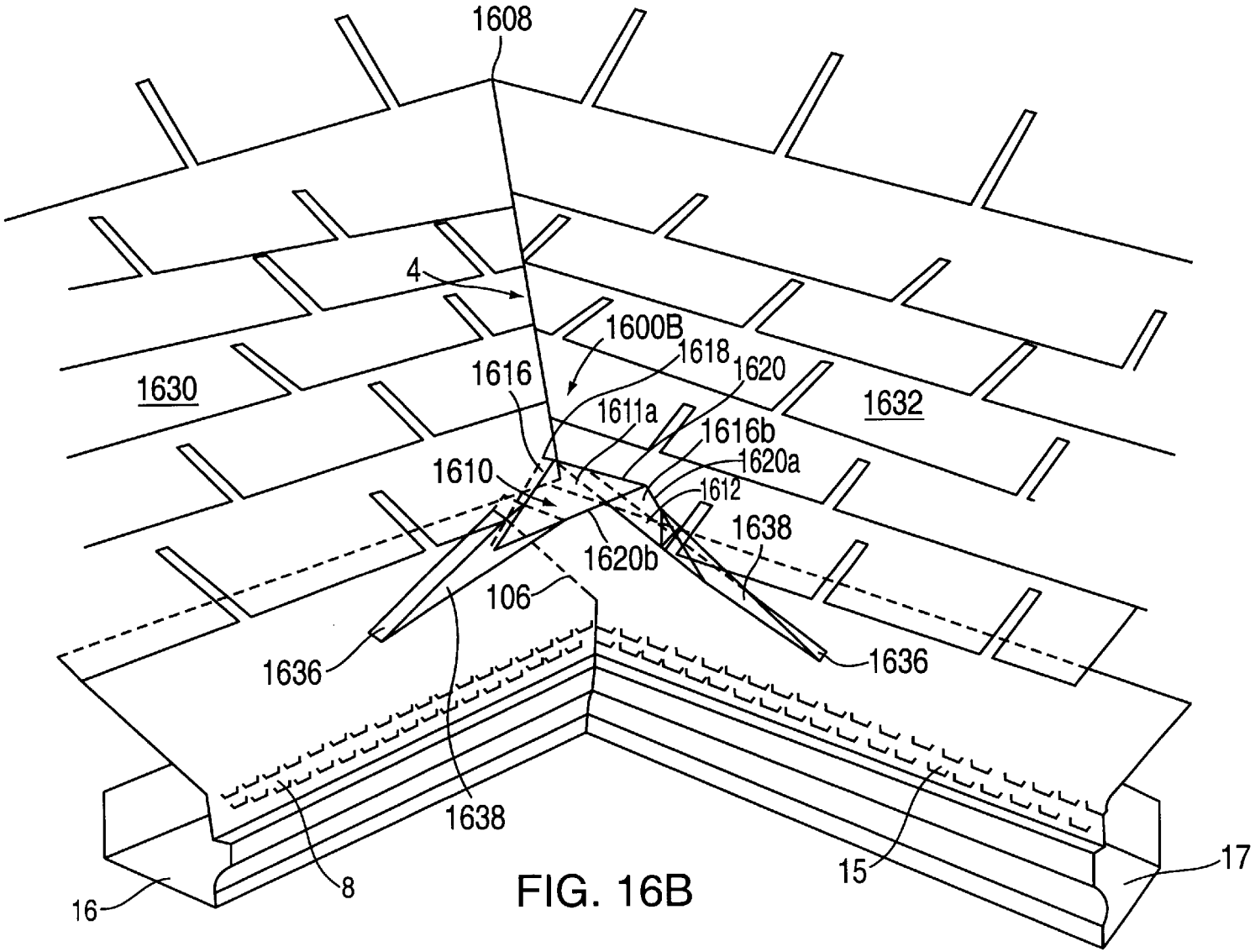
FIG. 16B is a perspective view of another water distributor incorporated at the intersection area of two perpendicular gutter covers and roofing.

Those skilled in the art will recognize that curved form can be substituted with other geometric forms. FIG. 16B depicts an alternative configuration of the distributor 1600B wherein the top portion 1616 is configured from two intersecting substantially planar surfaces. Generally, the curved edge 1620 of the distributor 1600 of FIG. 16A is replaced by two straight edges 1620*a* and 1620*b*. Additionally, the curved top surface 1616 of the distributor 1600 FIG. 16A is replaced by two planar surfaces 1616*a* and 1616*b* in the distributor 1600B of FIG. 16A.

Returning to FIG. 16A, the rear portion 1618 of the top surface 1616 is positioned at the intersection of the first and second edges 1610, 1612. The rear portion 1618 is attached to the tops 9, 10 of gutter covers 8, 15 at the point of highest concentration of water flowing from the roof valley 4. Alternatively, the rear portion 1618 may be coupled on one of the roof surfaces 1630, 1632 forming the roof valley 4. The third edge 1614 is generally installed at a 45 degree angle to both of the intersecting gutters 16 and 17. Alternatively, the third edge 1614 may be installed at other angles relative to the gutters 16, 17. As the debris and rain water flow onto the water distributor 1600, all water and debris are deflected from the sides of the top portion 1616 such that water and debris are changed in direction from flowing to the front most point 106 where gutter covers 8 and 15 intersect to a direction more parallel to the fronts of gutter covers 8 and 15 along their tops 9 and 10.

The top point 1620 of distributor 1600 is made high enough such that minimal or substantially no water or debris will flow over it during normal rainfall conditions. It is understood by those skilled in the art that a front lip could be added to the third edge 1614 of distributor 1600 to further insure that substantially no water or debris would flow over the third edge 1614 during period of above average rainfall.

At least a first trough 1602 is fastened to gutter top 9 proximate the first edge 1610. Preferably, a second trough 1604, configured similar to the first trough 1602, is fastened to the gutter top 10 from the second edge 1612 of distributor 1600. The troughs 1602, 1604 may be fastened to the distributor 1600 with screws, rivets, or fasteners, adhesives or the like. Alternatively, the troughs 1602, 1604 and top portion 1616 may be formed from a singular piece of material. Optionally, the troughs 1602, 1604 may be fastened to the tops 9 and 10 closer to the rear portion 1618 away from the third edge 1614.

Each trough 1602, 1604 includes a flange 1636 and a diverter 1638 extending generally away from top portion 1616 and respective edge 1610, 1612. Illustrative of both troughs 1602 and 1604, the flange 1636 of the first trough 1602 generally facilitates coupling the trough to the roof or gutter cover while the diverter 1638 directs the flow of water along the trough 1602.

Generally, the flange 1636 is disposed respectively proximate the first edge 1610 of the water distributor 1600 so that the trough 1602 may be disposed proximate to the roof, thus substantially minimizing water passage thereunder. In one embodiment, the flange 1636 is parallel to the roof surface or gutter cover and coplanar with the first edge 1610.

Figure 19:
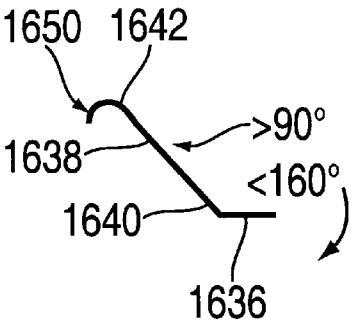
FIG. 19 is a cross sectional detail of trough taken along line 19—19 of FIG. 18.
Figure 17:
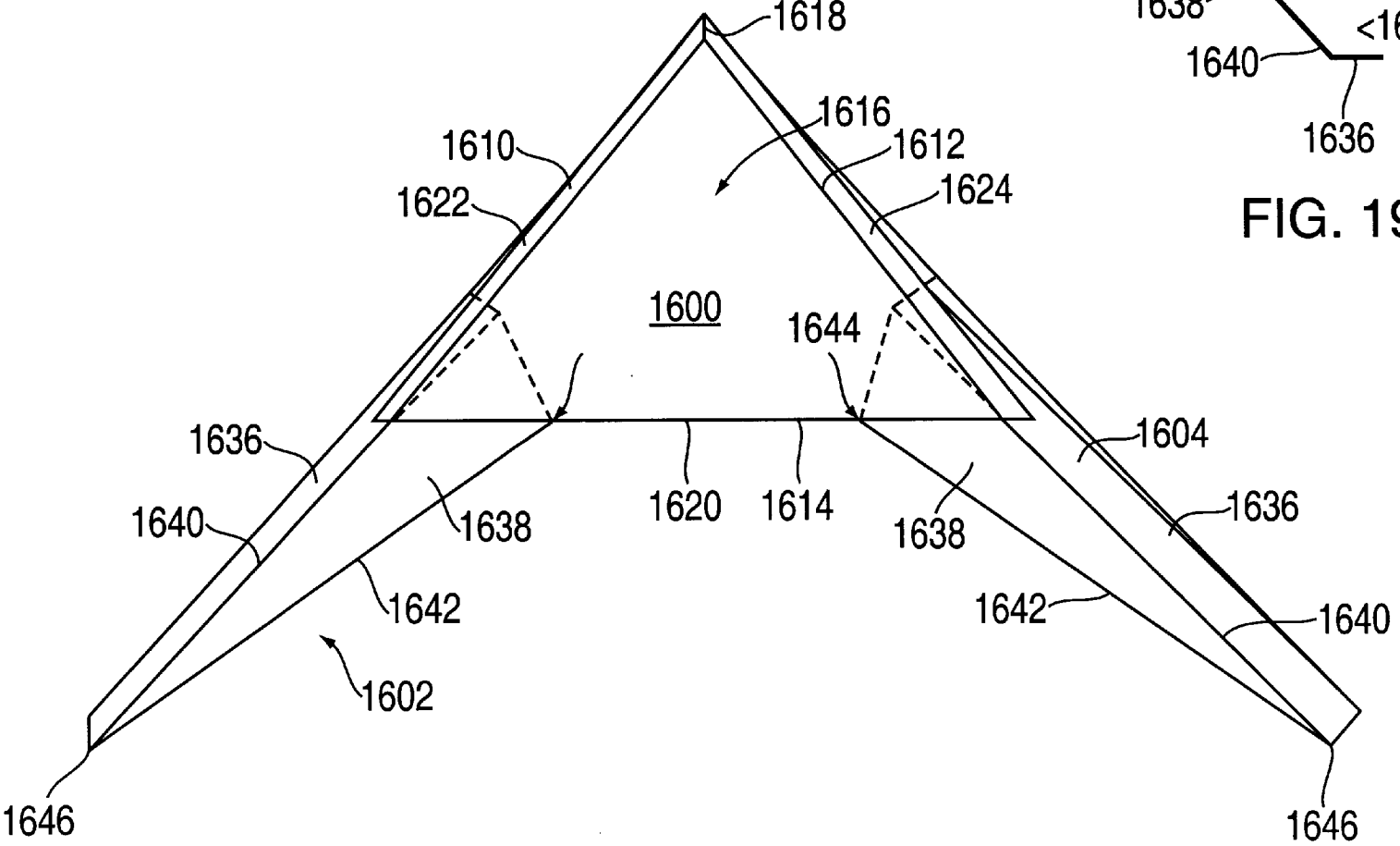
FIG. 17 is a top view of the water distributor in FIG. 16A.
Figure 18:
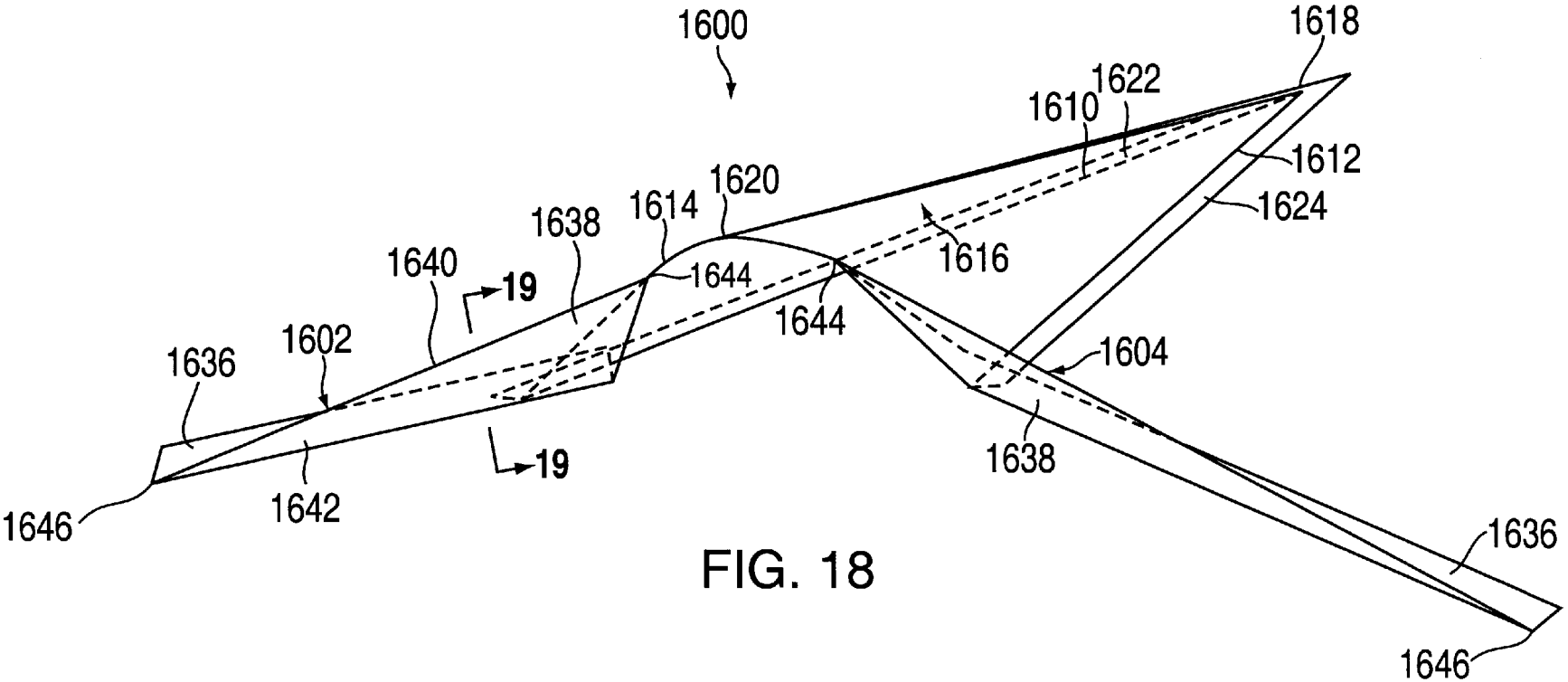
FIG. 18 is a perspective view of the water distributor shown in FIG. 16A.

The diverter 1638 generally has first side 1640 and a second side 1642 that extend from the top portion 1616 of the water distributor 1600. The diverter 1638 may be curved, flat or comprise a compound shape (i.e., have more than one angular section). The first side 1640 and second side 1642 may be parallel or non-parallel to each other. In one embodiment, the first side 1640 and second side 1642 are furthest apart (i.e., the diverter 1638 has a greatest height) where the sides 1640, 1642 interface with the top portion 1616. The highest point 1644 of troughs 1602, 1604 are disposed on the second side 1642 and are attached proximate the third edge 1614 of distributor 1600. The height of the trough diminishes from the highest point 1644 to the lowest point 1646 at the end furthest from third edge 1614. The angle of the diverter 1638 is ideally greater than about 90 degrees and less than about 160 degrees as shown in FIG. 19 as measured between flange 1636 (or the first edge 1610) and second edge 1612 such that substantially all debris flowing with the water will be swept free of the distributor 1600 and not collected. Those skilled in the art will recognize that this angle can be less than 90 degrees in situations where there is a limited amount of debris. Moreover, the height of the troughs 1602, 1604 may be selected so that debris is collected during light rains (i.e., rains having low volume of rain water flowing down the roof valley) while debris is washed from the troughs 1602, 1604 during heavier rains with an angle of between about 120 and about 160 degrees being preferred.

The second side 1642 of the diverter 1638 may additionally comprise a rounded lip 1650 as depicted in FIG. 19. The rounded lip 1650 allows the water flowing thereover to be directed by surface tension back towards the roof and gutter, thus substantially preventing the water from getting airborne and not being collected by the gutters 16, 17. The height and angle of the diverter 1638 should be selected to allow some water to flow over at least a portion of the second side 1642 during average rainfalls.

Those skilled in the art will recognize that the distributor 1600 can be made of one or more pieces of aluminum, plastic, copper, or any metal alloy to perform equal function. Those skilled in the art will also recognize that the moving the distributor 1600 away from center of the roof valley 4 will cause more water to flow in one direction than the other.

Figure 20:
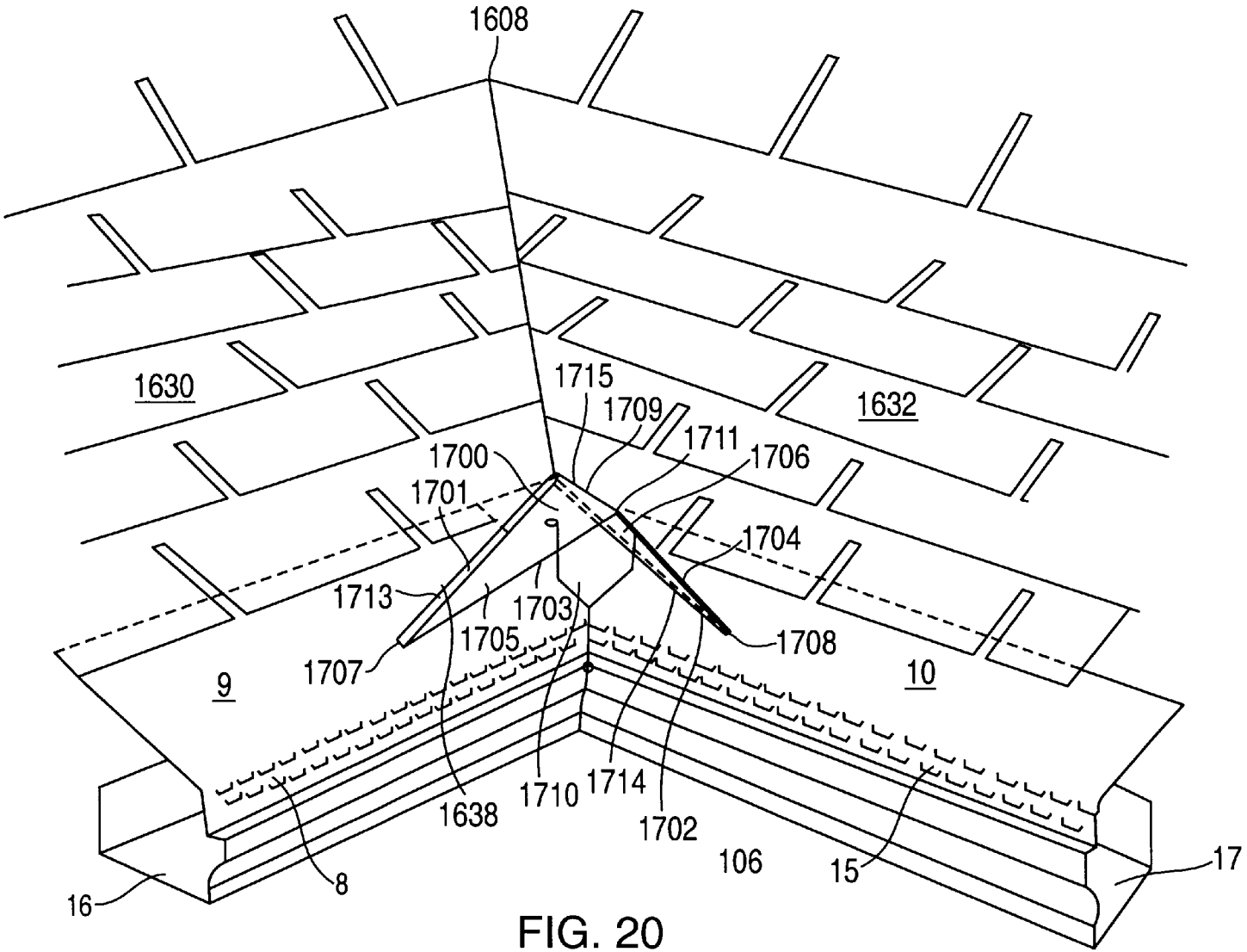
FIG. 20 is a perspective view of another embodiment of a water distributor incorporated at a roof valley.

FIG. 20 shows an alternative embodiment of a water distributor 1700 incorporated at the intersection area of two perpendicular gutter covers and roofing. The water distributor 1700 is configured similarly to the rain collectors described with reference to FIGS. 1–9 and FIGS. 16A–19 above. The distributor 1700 has no leading edge that catches debris. The distributor 1700 has no apertures that catches pine needles, leaf stems, twigs or tree debris. The distributor 1700 is generally mounted at an angle of at least about 120 degrees relative to the roof surface (or gutter cover) to allow water to flow evenly thereover, thus distributing the water across the roof or gutter cover as opposed to perpendicularly mounted conventional fences that prevent water from going over the top of the conventional fence. The distributor 1700 provides a smooth flow surface that minimizes or substantially eliminates the possibility of debris from collecting in the trough. The distributor 1700 may also have a rounded edge on a top most edge that directs water flowing thereover back down towards the roof surface or gutter cover top, thus preventing the water from fly off the distributor 1700 and missing the gutter positioned below.

Generally, the water distributor 1700 includes a first trough 1710 and a second trough 1712. Troughs 1710 and 1712 can be made of one or more individual parts of various materials including aluminum, copper, steel alloy or plastics. The troughs 1710, 1712 may be flat, curved or comprised of compound angles or shapes. Water and tree debris flowing from the peak 1608 of roofs 1632 and 1630 along the roof valley is divided at a converging point 1715 of a first trough 1710 and a second trough 1712.

The first trough 1710 has a bottom-most portion along an edge 1701 and the second trough 1712 has a bottom-most portion along an edge 1702. The first trough 1710 has a front surface 1705 and the second trough 1712 has a front surface 1706. The front surface 1705 of the first trough 1710 and the front surface 1706 of the second trough 1712 join at an edge 1709. A front-most point 1711 of an edge 1709 is at a sufficient elevation to insure that substantially no water from flowing down the roof valley from the peak 1608 over at the front-most point 1711. A front edge 1703 of the first trough 1710 and a front edge 1704 of the second trough 1712 is widest and highest at the point 1711 and diminishes to a narrowest point 1707 of the first trough 1710 and a narrowest point 1708 of the second trough 1712. The front edges 1703 and 1704 can be straight or curved. As the front surfaces 1705, 1706 may be flat, curve or comprised of compound angles or complex shapes, the angle defining the inclination of the troughs 1710, 1712 may be defined between the edge 1701, 1702, the front edge 1703, 1704 and the peak 1709. Of course if the troughs 1710, 1712 are mounted to the gutter cover, the angle will be defined the gutter cover and not the peak of the roof surfaces.

A rear edge of the first trough 1710 is formed by connecting or affixing a rear flange 1713 to top of rain gutter cover 9 or roof 1630. Likewise, a rear edge of trough 1712 is formed by connecting or affixing rear flange 1714 to the top of gutter cover 10 or roof 1632. Rain water, pine needles, twigs, leaves, blossoms and other tree debris is divided into the troughs 1710 and 1712.

Figure 22:
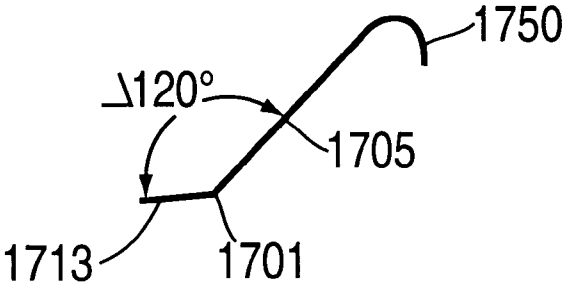
FIG. 22 is a sectional view of the water distributor of FIG. 21 taken along section line 22—22.
Figure 21:
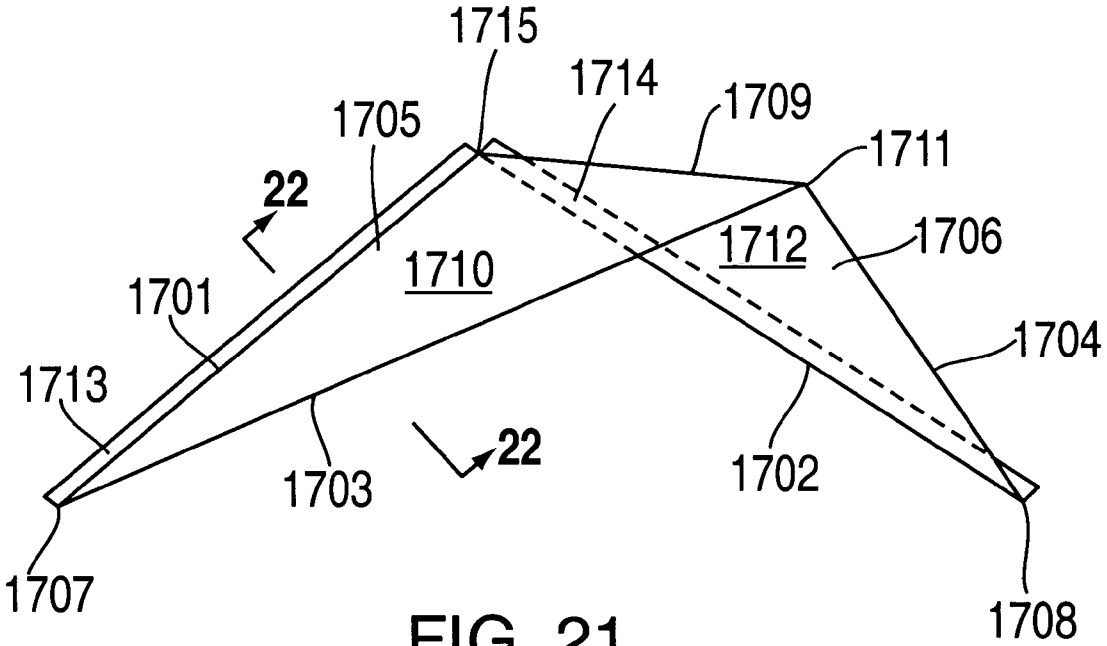
FIG. 21 is a perspective view of the water distributor of FIG. 20.
Figure 23:
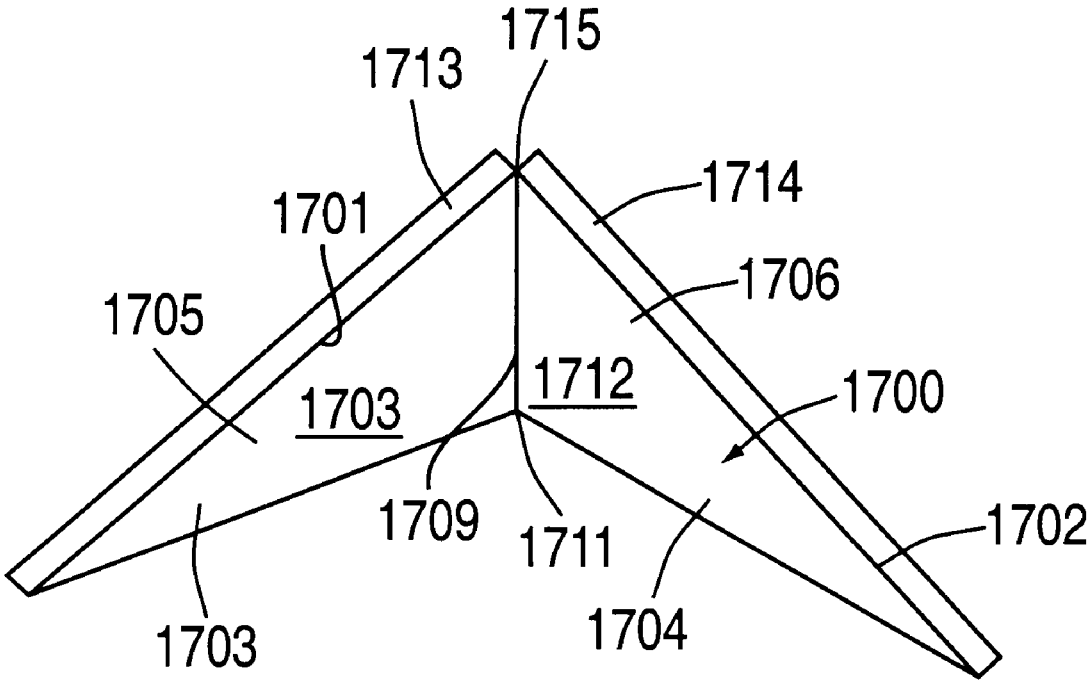
FIG. 23 is a top view of the water distributor of FIG. 20.

As shown in FIG. 22, the angle between the front surface 1705 and the rear flange 1713 is generally greater than about 120 degrees and less than 160 degrees such that any debris accompanying water in the heaviest of rain storms that flows into troughs 1710 and 1712 is not caught on any leading edges or apertures of any kind but instead is contained in the troughs to a point where line "a" drawn from the point where gutter covers 8 and 15 begin collecting water intersects edges 1703 and 1704 of both troughs. Water and debris are evenly distributed over the edges 1703 and 1704 at least from point "a" to the end points 1707 and 1708. With less rain intensity, the debris and rain water will stay in the trough to a point further towards 1707 and 1708. It is also understood that by moving or shifting the location of converging point 1715 to the right or left of the intersection of both roofs 1630 and 1632, more water and debris will be delivered to one trough than the other. It is also understood that the troughs can be of different lengths and that in situations, for example, where a doorway is under one of the intersecting gutters, a single trough can be used instead of two troughs to distribute water and debris to one direction only instead of two directions. It is also understood that one or two troughs can be used with rain water valleys created by a dormer as shown in FIG. 4 in which only one gutter exists instead of two intersecting gutters.

FIG. 22 shows the front surface 1705 of the first trough 1710 extending into a curved arcuate surface 1750 leading downward towards top of gutter cover 9. Through the principle of surface adhesion, water adheres to the arcuate surface 1750 and is directed onto top of gutter cover 9 where it can then be captured by gutter 16 instead of flying the first trough 1710 and missing gutter 16.

Although various embodiments which incorporate the teachings of the present invention have been shown and described in detail herein, those skilled in the art can readily devise many other varied embodiments that still incorporate these teachings.

What is claimed is:

1. A water distributor for directing water from two adjoining roof surfaces forming a roof valley to a rain gutter, said water distributor comprising:

a top portion having a first edge and a second edge for coupling the top portion to the roof valley;

a third edge extending between the first edge and the second edge; and a first trough having a first side and a second side extending from the top portion, the first side disposed closer to the first edge than the second side.

2. The water distributor of claim 1 further comprising:

a second trough having a first side and a second side extending from the top portion, the first side disposed closer to the second edge than the second side.

3. The water distributor of claim 1, wherein the first trough has a diverter adapted to divert water that defines an angle of about 90 to about 160 degrees with the first edge.

4. The water distributor of claim 1, wherein the second side of the first trough further comprises a rounded lip.

5. The water distributor of claim 1, wherein at least the second side of the first trough intersects with the third edge.

6. The water distributor of claim 1, wherein a distance between the first side and the second side of the first trough is greatest where the first trough interfaces with the top portion.

7. The water distributor of claim 1, wherein the third edge is angular or bowed.

8. The water distributor of claim 1, wherein said water distributor is one piece construction.

9. A water distributor for directing water from two adjoining roof surfaces forming a roof valley to a rain gutter, said water distributor comprising:

a gutter cover coupled to at least one of said roof surfaces forming said roof valley;

a substantially triangular top portion bounded by a first edge, a second edge, and a third edge;

at least one flange coupled to said gutter cover and said first edge or second edge; and at least a first trough extending from the top portion across a portion of a first surface of said gutter cover wherein said substantially triangular top surface and first trough are for spreading water away from the roof valley.

10. The water distributor of claim 9 further comprising:

a second trough extending from the top portion across a portion of a second surface of said roof surfaces forming the roof valley.

11. The water distributor of claim 9, wherein the first trough has a diverter adapted to divert water that defines an angle of about 90 to about 160 degrees with the first edge.

12. The water distributor of claim 10, wherein the first trough further comprises:

a first side;

a second side, the first side disposed closer to the first edge than the second side; and a rounded lip disposed on the second side.

13. The water distributor of claim 12, wherein the second trough further comprises:

a first side;

a second side, the first side disposed closer to the second edge than the second side; and a rounded lip disposed on the second side.

14. The water distributor of claim 9, wherein at least a portion of the first trough intersects with the third edge.

15. The water distributor of claim 9, wherein the first trough is widest where the first trough interfaces with the top surface.

16. The water distributor of claim 9, wherein the third edge is angular or bowed.

17. The water distributor of claim 9, wherein said water distributor is one piece construction.

18. A water distributor for directing water from two adjoining roof surfaces forming a roof valley to a rain gutter, said water distributor comprising:

a substantially triangular top surface bounded by a first edge, a second edge, and a third edge, the first edge and the second edge respectively coupled to the two adjoining roof surfaces that form the roof valley; and at least a first trough extending from the top surface across a portion of a first surface of said roof surfaces forming the roof valley, wherein said substantially triangular top surface and first trough are for spreading water away from the roof valley.

19. The water distributor of claim 18 further comprising:

a second trough extending from the top surface across a portion of a second surface of said roof surfaces forming the roof valley.

20. The water distributor of claim 18, wherein the first trough has a diverter adapted to divert water that defines an angle of about 90 to about 160 degrees with the first edge.

21. The water distributor of claim 19, wherein the first trough further comprises:

a first side;

a second side, the first side disposed closer to the first edge than the second side; and a rounded lip disposed on the second side.

22. The water distributor of claim 21, wherein the second trough further comprises:

a first side;

a second side, the first side disposed closer to the second edge than the second side; and a rounded lip disposed on the second side.

23. The water distributor of claim 18, wherein at least a portion of the first trough intersects with the third edge.

24. The water distributor of claim 18, wherein the first trough is widest where the first trough interfaces with the top surface.

25. The water distributor of claim 18, wherein the third edge is angular or bowed.

26. The water distributor of claim 18, wherein said water distributor is one piece construction.

* * * * *

UNITED STATES PATENT AND TRADEMARK OFFICE

CERTIFICATE OF CORRECTION

PATENT NO. : 6,412,229 B2
DATED : July 2, 2002
INVENTOR(S) : Richard Kuhns

It is certified that error appears in the above-identified patent and that said Letters Patent is hereby corrected as shown below:

Column 9,
Line 7, change "tot he" to -- to the --.

Signed and Sealed this

First Day of October, 2002

*Attest:*

*Attesting Officer*

JAMES E. ROGAN
*Director of the United States Patent and Trademark Office*